US012486658B2

(12) United States Patent
Zhao

(10) Patent No.: US 12,486,658 B2
(45) Date of Patent: Dec. 2, 2025

(54) ASSEMBLE HOUSE

(71) Applicant: HANGZHOU ASWEETS CULTURAL CREATIVE CO., LTD, Hangzhou (CN)

(72) Inventor: Fujian Zhao, Shaoxing (CN)

(73) Assignee: HANGZHOU ASWEETS CULTURAL CREATIVE CO., LTD, Hangzhou (CN)

( * ) Notice: Subject to any disclaimer, the term of this patent is extended or adjusted under 35 U.S.C. 154(b) by 0 days.

(21) Appl. No.: 19/083,557

(22) Filed: Mar. 19, 2025

(65) Prior Publication Data

US 2025/0333950 A1 Oct. 30, 2025

(30) Foreign Application Priority Data

Apr. 30, 2024 (CN) ..... 202420951393.3

(51) Int. Cl.
*E04B 1/343* (2006.01)
*A63H 33/00* (2006.01)

(52) U.S. Cl.
CPC ..... *E04B 1/34315* (2013.01); *A63H 33/008* (2013.01)

(58) Field of Classification Search
CPC ..... A63H 33/008; E04B 1/34315
USPC ..... 472/136; 52/79.1–79.9
See application file for complete search history.

(56) References Cited

U.S. PATENT DOCUMENTS 1,271,160 A * 7/1918 Groves ..... A63H 33/044 446/106
1,402,438 A * 1/1922 Nichols ..... A63H 33/044 446/85
1,510,326 A * 9/1924 Locke ..... A63H 33/044 52/92.1
2,059,598 A * 11/1936 Paulson ..... A63H 33/04 446/85
2,125,580 A * 8/1938 Paulson ..... A63H 33/084 446/106
2,238,039 A * 4/1941 De Witt ..... A63H 33/04 446/119
2,635,303 A * 4/1953 Poynter ..... E04B 2/56 206/321

(Continued)

FOREIGN PATENT DOCUMENTS

CN 207813121 U 9/2018

*Primary Examiner* — Eugene L Kim
*Assistant Examiner* — Matthew B Stanczak
(74) *Attorney, Agent, or Firm* — JEEN IP LAW, LLC

(57) ABSTRACT

An assemble house is provided, which includes a wall panel unit, a roof unit, and a movable door. One or more sides of the wall panel unit are provided with installation ports, and the installation ports are hinged with the movable door; the wall panel unit includes a plurality of first long installation plates, second long installation plates, third short installation plates, and H-shaped installation plates, upper sides of the first long installation plates are provided with at least two clamp slots, upper and lower sides of the second long installation plates and the third short installation plates are symmetrically provided with at least two clamp slots, which are connected to each other through corresponding clamp slots to form a wall of the wall panel unit. The H-shaped installation plates are formed at two sides of the installation ports.

7 Claims, 9 Drawing Sheets

(56) References Cited

U.S. PATENT DOCUMENTS 2,827,988 A * 3/1958 Lewis ..... E04B 1/34315 52/270
2,832,100 A * 4/1958 Swallert ..... A63H 33/06 403/387
2,844,910 A * 7/1958 Korchak ..... A63H 33/06 446/85
2,854,724 A * 10/1958 Wuorio ..... B28B 7/02 249/129
2,946,150 A * 7/1960 Houk ..... A63H 33/16 446/106
3,007,279 A * 11/1961 Korchak ..... A63H 33/084 446/85
3,941,343 A * 3/1976 Kennedy ..... A47F 5/0823 248/220.31
4,153,311 A * 5/1979 Takahashi ..... A47B 47/042 312/265.5
4,171,545 A * 10/1979 Kann ..... A47K 1/04 312/228
4,270,304 A * 6/1981 Sofer ..... A63H 33/084 446/124
4,372,076 A * 2/1983 Beck ..... A63H 33/044 446/106
4,391,067 A * 7/1983 Frady ..... E04B 2/702 52/309.12
4,495,735 A * 1/1985 Elkins ..... B60R 7/10 224/927
4,562,776 A * 1/1986 Miranda ..... A47B 47/042 108/190
4,569,664 A * 2/1986 Giampetruzzi ..... A63H 33/008 446/110
4,585,422 A * 4/1986 Kay ..... A63H 33/06 446/106
4,635,411 A * 1/1987 Kurzen ..... A63H 33/10 446/112
4,823,528 A * 4/1989 Faw ..... E04B 2/702 52/286
5,036,634 A * 8/1991 Lessard ..... E04H 1/1205 D25/16
5,145,440 A * 9/1992 Boris ..... E04H 15/20 446/85
5,174,078 A * 12/1992 West ..... E04B 2/702 52/90.2
5,191,746 A * 3/1993 Russell ..... A47H 27/00 47/79
5,281,181 A * 1/1994 McCollum ..... A63H 33/044 446/124
5,281,185 A * 1/1994 Lee ..... A63H 33/10 446/85
5,354,223 A * 10/1994 Wawzonek ..... A63H 33/044 446/106
5,580,294 A * 12/1996 Briant ..... A63H 33/044 446/110
5,664,367 A * 9/1997 Huang ..... A47G 7/044 248/311.2
5,746,547 A * 5/1998 Reinmann ..... E21D 15/04 299/11
6,059,630 A * 5/2000 Paxton ..... A63H 33/044 446/124
6,079,910 A * 6/2000 Marianski ..... E21D 15/48 52/233
6,189,271 B1 * 2/2001 Christensen ..... E04B 2/702 446/106
6,397,781 B1 * 6/2002 Bellington ..... A01K 31/14 119/431
6,532,878 B2 * 3/2003 Tidemann ..... A47B 47/042 108/186
6,595,378 B2 * 7/2003 Wang ..... A47B 47/0075 211/186
D501,232 S * 1/2005 Kirk ..... D21/511
6,923,705 B2 * 8/2005 DeSalvo ..... A63H 33/044 446/124
8,105,127 B2 * 1/2012 Heston ..... A63H 33/084 446/85
8,281,529 B2 * 10/2012 Cluff ..... E04C 3/14 52/592.2
8,458,980 B2 * 6/2013 Ivanov ..... A63H 33/084 446/105
8,578,661 B1 * 11/2013 Braley ..... A01M 31/02 52/79.5
8,590,976 B2 * 11/2013 Davis ..... A47C 4/021 297/440.13
8,621,739 B1 * 1/2014 Elliot ..... A63H 33/084 29/428
8,650,807 B2 * 2/2014 McKimmy ..... E04B 1/34321 52/79.9
8,832,917 B1 * 9/2014 Elliott ..... A47C 4/021 403/345
9,032,670 B2 * 5/2015 Vogler ..... E04H 1/005 52/79.9
9,327,206 B2 * 5/2016 Donohoe ..... A63H 33/08
9,556,605 B2 * 1/2017 Elliott ..... E04B 1/541
9,737,825 B2 * 8/2017 Donohoe ..... A63H 33/044
9,909,604 B1 * 3/2018 Fawcett ..... F16B 12/10
10,130,893 B2 * 11/2018 Heston ..... A63H 33/084
10,174,497 B2 * 1/2019 Perez-Romero ..... E04B 1/2604
10,518,192 B1 * 12/2019 Swan ..... A63H 33/008
10,737,192 B1 * 8/2020 Pack ..... A63H 33/101
10,881,974 B2 * 1/2021 Donohoe ..... A63H 33/10
10,898,820 B2 * 1/2021 Rieber ..... E04B 1/34321
11,172,771 B2 * 11/2021 Rifkin ..... E04H 1/1272
11,352,776 B2 * 6/2022 Norton ..... A63H 33/08
11,454,038 B2 * 9/2022 Rifkin ..... A47B 47/042
11,711,047 B2 * 7/2023 Wickramasekera ..... E04B 1/34336 52/79.5
11,833,444 B2 * 12/2023 Landau ..... A63H 33/088
12,108,875 B2 * 10/2024 Chennaux ..... A47B 47/047
12,326,006 B2 * 6/2025 Dragseth ..... E04H 1/125
2002/0160885 A1 * 10/2002 Rayho ..... A63H 33/008 482/35
2009/0159013 A1 * 6/2009 Anderson ..... A01K 1/033 119/482
2010/0093257 A1 * 4/2010 Elliott ..... A63H 3/52 446/478
2013/0072314 A1 * 3/2013 Goodman ..... A63H 33/008 472/136
2014/0155182 A1 * 6/2014 DeBlanco ..... A63H 33/008 472/136
2014/0235133 A1 * 8/2014 Ksobiech ..... A63H 33/08 446/124
2014/0315651 A1 * 10/2014 Meister ..... A63H 33/008 472/136
2014/0373357 A1 * 12/2014 Elliott ..... A63H 33/084 29/897
2015/0265937 A1 * 9/2015 Chen ..... A63H 33/008 472/136
2016/0032581 A1 * 2/2016 Sklar ..... E04C 3/122 52/220.8
2016/0214024 A1 * 7/2016 Kiley ..... A63H 33/084
2016/0263484 A1 * 9/2016 Say ..... A63H 33/008
2017/0197153 A1 * 7/2017 Styles ..... B43L 1/00
2018/0339238 A1 * 11/2018 Berlingeri ..... A63H 33/008
2019/0091596 A1 * 3/2019 Cecchin ..... H01R 4/48
2020/0318340 A1 * 10/2020 Norton ..... E04B 1/34384
2021/0060448 A1 * 3/2021 Sullivan ..... A47B 47/047
2022/0184515 A1 * 6/2022 Johnson ..... A63H 33/008
2023/0000248 A1 * 1/2023 Chennaux ..... A47B 47/042
2024/0416253 A1 * 12/2024 Römmich ..... A63H 3/52
2025/0065243 A1 * 2/2025 Engelhard ..... A63H 33/062

* cited by examiner

ASSEMBLE HOUSE

CROSS-REFERENCE TO RELATED APPLICATIONS

This application claims priority to Chinese Patent Application No. 202420951393.3, filed on Apr. 30, 2024, which is hereby incorporated by reference in its entirety.

TECHNICAL FIELD

The present disclosure relates to the field of house technologies, and in particular, to an assemble house.

BACKGROUND

With an improvement in people's living standards, there is an increasing emphasis on children's education and intellectual development. There is a need for a psychological space that is suitable for children, which can cultivate their visual thinking ability, exercise their cooperation skills, improve their hands-on ability, and build houses that can be used for outdoor entertainment and play. Assembled houses consist of modules such as roof coverings, roofs, doors, and windows. Currently, children's outdoor houses sold in the market require complex modular assembly, usually requiring screw installation and assembly, which children cannot participate in.

For example, CN201820172238.6 discloses a detachable children's room. The assembly steps of this room are complex and cumbersome, and the installation structure is not firm enough, rendering it inconvenient to adjust the size according to needs.

SUMMARY

The purpose of the present disclosure is to provide an assembled house that is easy to assemble, firmly installed, and can adjust the area and space according to actual needs, rendering it convenient for outdoor entertainment and play.

To achieve the above objectives, the present disclosure is implemented through the following technical solutions: an assemble house, including a wall panel unit, a roof unit, and a movable door, where the wall panel unit is a rectangular structure, and an upper of the wall panel unit is capable of being detachably connected to the roof unit; one or more sides of the wall panel unit are provided with at least one installation port, and the installation port is hinged with the movable door;

the wall panel unit includes a plurality of first long installation plates, second long installation plates, third short installation plates, and H-shaped installation plates; upper sides of the first long installation plates are provided with at least two clamp slots, upper and lower sides of the second long installation plates and the third short installation plates are symmetrically provided with at least two clamp slots, the clamp slots are connected to each other through corresponding clamp slots to form a wall of the wall panel unit, and the H-shaped installation plates are formed at two sides of the installation port.

In some embodiments of the present disclosure, lengths of the first long installation plates are the same as lengths of the second long installation plates, heights of the first long installation plates are half of heights of the second long installation plates; heights of the second long installation plates, the third short installation plates, and the H-shaped installation plates are all the same. The first long installation plates serve as a bottom foundation, facilitating subsequent staggered splicing of other installation plates upwards.

In some embodiments of the present disclosure, the wall panel unit includes a pair of first long installation plates that are symmetrically arranged, one side of each of the first long installation plates are clamped to the second long installation plates, and the other side of each of the first long installation plates are clamped to the second long installation plates or the third short installation plates; two upper sides of each of the first long installation plates and two upper sides of each of the second long installation plates are respectively cross clamped with the second long installation plates, the third short installation plates, or the H-shaped installation plates.

In some embodiments of the present disclosure, a top of the roof unit is inclined at one side or inclined at two sides. Regardless of the structure, it can be assembled into a top structure to achieve the functions of rain resistance and water accumulation prevention.

In some embodiments of the present disclosure, the top of the roof unit includes a set of unidirectional triangular installation plates that are symmetrically arranged and a plurality of first cover plates; bottoms of the unidirectional triangular installation plates are provided with at least two first connection grooves, tops of the unidirectional triangular installation plates are stepped structures, and an arc-shaped convex block is provided at each step of the stepped structures; sides of the unidirectional triangular installation plates are provided with a connection notch, and two sides of the first cover plates are provided with a first bayonet that is inserted into the arc-shaped convex block; the first cover plates are provided between the unidirectional triangular installation plates, and upper and lower of the adjacent first cover plates are sequentially inclined and stacked. The overall structure is simple and convenient to assemble, and each step is provided with the arc-shaped convex block that has a certain inclination. The arc-shaped convex block also tilts in sequence, and are partially stacked to prevent rainwater from entering the house and to prevent water accumulation.

In some embodiments of the present disclosure, the top of the roof unit includes bidirectional triangular installation plates and a plurality of second cover plates, bottoms of the bidirectional triangular installation plates are provided with at least three second connection grooves, stepped structures are symmetrically arranged on two sides of the bidirectional triangular installation plates, an arc-shaped convex block is provided at each step of the stepped structures of the bidirectional triangular installation plates, and a second bayonet is provided on two sides of the second cover plates configured to insert into the arc-shaped convex block; the second cover plates are provided between the bidirectional triangular installation plates, and middles of the bidirectional triangular installation plates are inclined downwards along two sides, and upper and lower of adjacent second cover plates are inclined and stacked in sequence. The overall structure is simple and convenient to assemble. The bidirectional triangular installation plates have a tilted structure on two sides, rendering it easy for rainwater to fall. Each step is further provided with a certain degree of tilted arc-shaped convex block.

In some embodiments of the present disclosure, the wall panel unit is provided with a hook and/or a storage rack and/or a curtain rod inside, and the hook is a S-shaped structure, one side of the hook is clamped in an unassembled clamp slot; the storage rack includes a pair of clamping blocks and a storage board; the clamping blocks are connected to one set of clamp slots, and the clamping blocks are clamped to the storage board. Which riches internal storage functions, all of which are connected through clamp connection for easy assembly.

In some embodiments of the present disclosure, two sides of an exterior of the wall panel unit are provided with installation ports, one of the installation ports is provided with the movable door, an upper of the other installation port is provided with a protruding rain covering, a lower of the installation port is provided with a window sill or a flower groove, two sides of the window sill are provided with sockets; a pair of clamping plates are provided on a lower of the window sill; thereby enhancing an overall functionality of the house, allowing for the placement of items or flowers, as well as sun shading and other functions.

In some embodiments of the present disclosure, three sides of an exterior of the wall panel unit are all provided with one installation port, and one of the installation ports is configured to install a window. And an upper of the installation port can be provided with the protruding rain covering.

In some embodiments of the present disclosure, the protruding rain covering is composed of a pair of connection pieces, a pair of supporting crossbars, and a rain covering; one sides of the connection pieces are respectively connected to a corresponding clamp slot, and upper sides of the connection pieces are provided with a circular slot configured to connect the supporting crossbars; the rain covering is provided on the connection pieces and the supporting crossbars.

Compared with existing technology, the beneficial effects of the present disclosure are by combining and splicing the first long installation plates, the second long installation plates, the third short installation plates, and the H-shaped installation plates, the required wall panel units can be assembled. At the same time, the wall panel units can be provided with functions such as windows, movable doors, and window sills. The overall structure has simple and convenient assembly, firm installation, and can adjust the area and space according to actual needs, rendering it convenient for outdoor entertainment and play.

BRIEF DESCRIPTION OF DRAWINGS

In order to provide a clearer explanation of the technical solution in the embodiments of the present application, a brief introduction will be given to the drawings required for the embodiments. It is obvious that the drawings described below are only some embodiments of the present application. For those skilled in the art, other drawings can be obtained based on these drawings without creative work.

NUMERAL REFERENCE

1—wall panel unit; 11—first long installation plate; 12—second long installation plate; 13—third short installation plate; 14—H-shaped installation plate; 15—clamp slot; 2—roof unit; 21—unidirectional triangular installation plate; 22—first cover plate; 23—arc-shaped convex block; 24—connection notch; 25—first bayonet; 26—first connection groove; 3—movable door; 4—installation port; 51—bidirectional triangular installation plate; 52—second cover plate; 53—second bayonet; 54—second connection groove; 6—protruding rain covering; 61—connection piece; 62—supporting crossbar; 63—rain covering; 7—window sill; 71—socket; 72—clamping plate; 8—flower groove; 9—storage rack; 91—clamping block; 92—storage board; 10—hook.

DESCRIPTION OF EMBODIMENTS

The following will provide a clear and complete description of the technical solutions in embodiments of the present disclosure, in combination with FIGS. 1-9 of the present disclosure.

Figure 1:
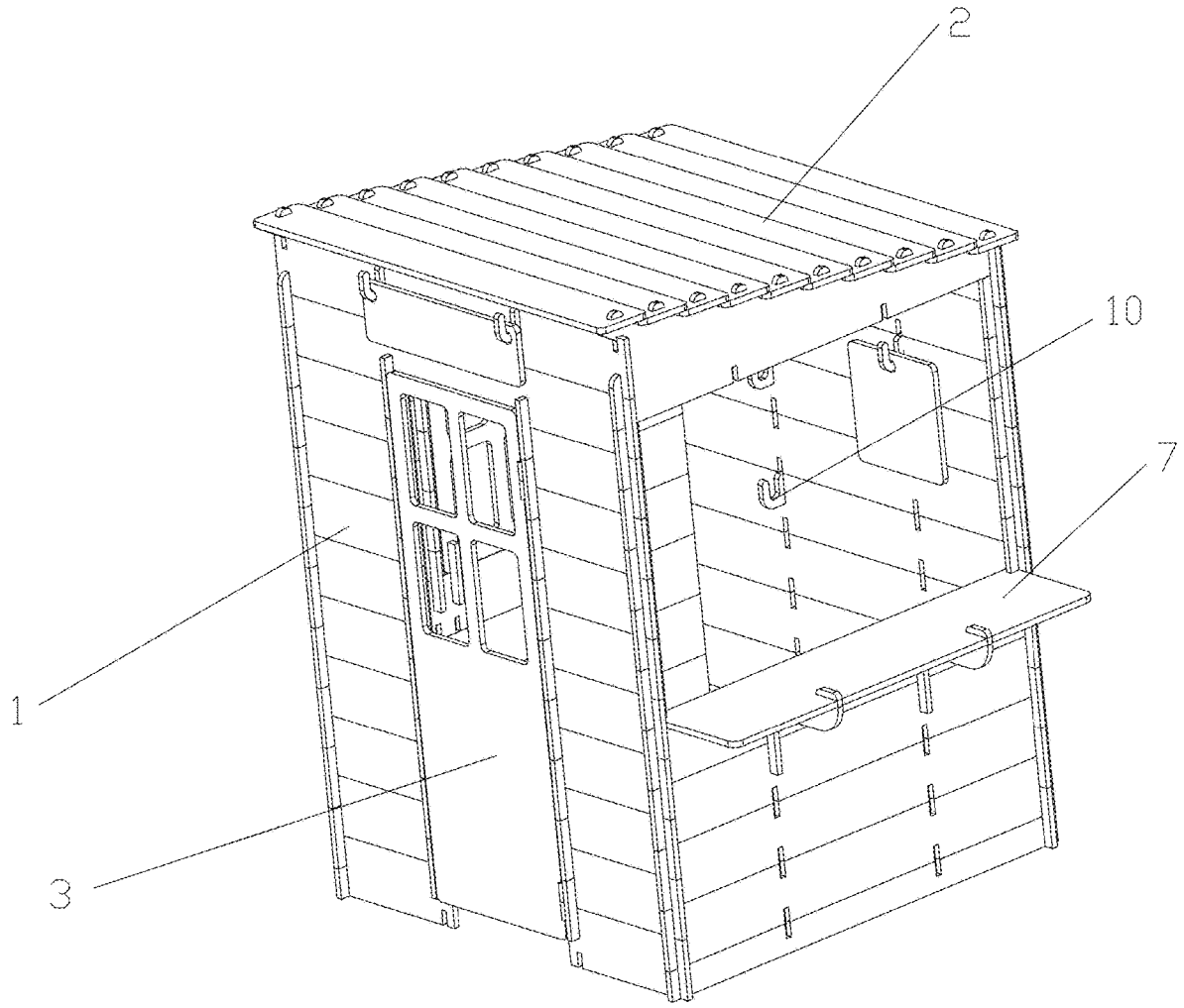
FIG. 1 is a schematic structural diagram of an embodiment of the present Disclosure.
Figure 2:
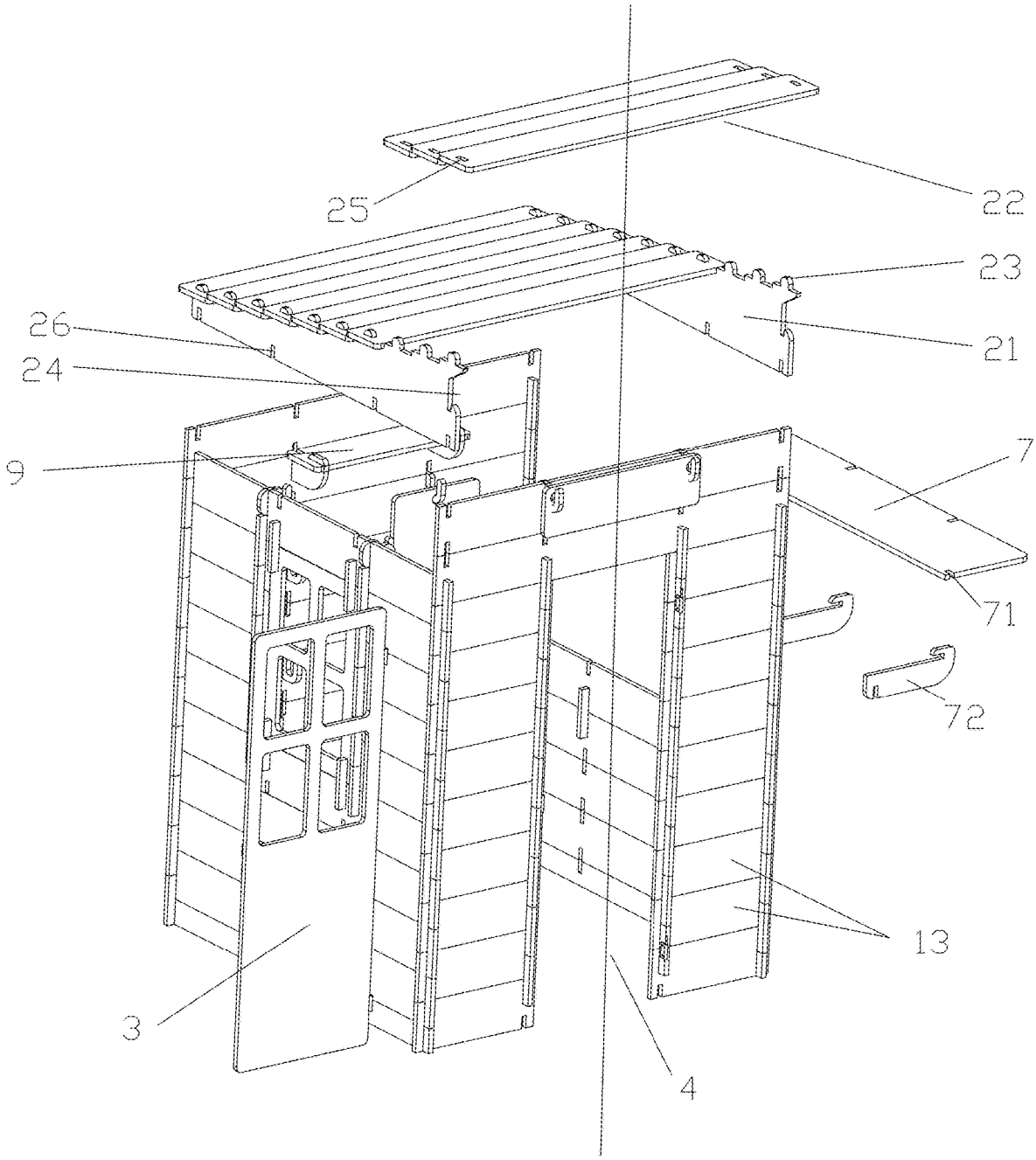
FIG. 2 is an exploded schematic structural diagram of FIG. 1.
Figure 3:
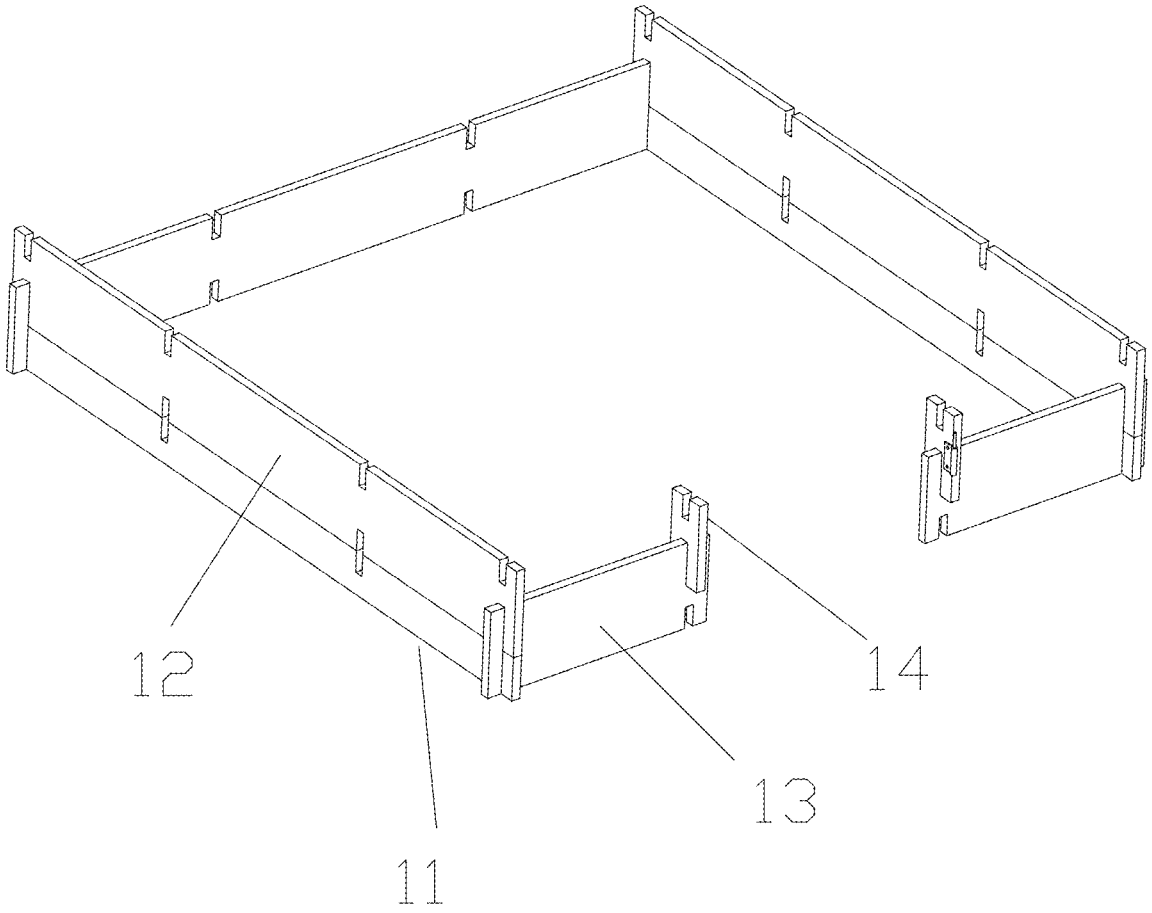
FIG. 3 is a schematic diagram of a partial assembly structure of an embodiment of the present disclosure.

Referring to FIGS. 1-3, an embodiment provides an assembled house, which includes a wall panel unit 1, a roof unit 2, and a movable door 3. The wall panel unit 1 is a rectangular structure, an upper of the wall panel unit 1 can be detachably connected to the roof unit 2. At least one installation port 4 is provided on one or more sides of the wall panel unit 1, and the number of the installation port 4 is assembled and spliced according to actual needs. The movable door 3 is hinged at the installation port 4 on one side of the wall panel unit 1. The movable door 3 can be fixed by magnetic connection, for example, by attaching a magnet to the movable door 3 and the wall panel unit 1.

The wall panel unit 1 includes a plurality of first long installation plates 11, second long installation plates 12, third short installation plates 13, and H-shaped installation plates 14. Upper sides of the first long installation plates 11 are provided with at least two clamp slots 15, in an implementation mode, there are two clamp slots 15, and upper and lower sides of the second long installation plates 12 and the third short installation plates 13 are symmetrically provided with at least two clamp slots 15. In an implementation mode, upper and lower sides of the second long installation plates 12 are provided with four clamp slots 15, and upper and lower sides of the third short installation plates 13 are provided with two clamp slots 15. Two sides of the four clamp slots 15 are configured for mutual clamping connection with other plates, and one clamp slot 15 in a middle is configured to cooperate with other components for clamp connection. A wall of the wall panel unit 1 is formed by interlocking with corresponding clamp slots 15.

In this embodiment, lengths of the first long installation plates 11 are the same as those of the second long installation plates 12. Heights of the first long installation plates 11 are half of heights of the second long installation plates 12. Heights of the second long installation plates 12, the third short installation plates 13, and the H-shaped installation plates 14 are all the same. Referring to FIG. 3, the wall panel unit 1 is a pair of symmetrically installed first long installation plates 11 as a base bottom. Then, one sides of the first long installation plates 11 are clamped to the second long installation plates 12, the other sides of the first long installation plates 11 are clamped to the third short installation plates 13, thereby forming a rectangular frame for subsequent staggered splicing of other installation plates upward to form a required height.

Two upper sides of one of the first long installation plates 11 and two upper sides of the second long installation plates 12 are respectively cross clamped with the second long installation plates 12, the third short installation plates 13, or the H-shaped installation plates 14. When the third short installation plates 13 are needed, it is to leave space to form the installation port 4. Similarly, the H-shaped installation plate 14 can also be used as a connector to splice and assemble adjacent third short installation plates 13.

Figure 8:
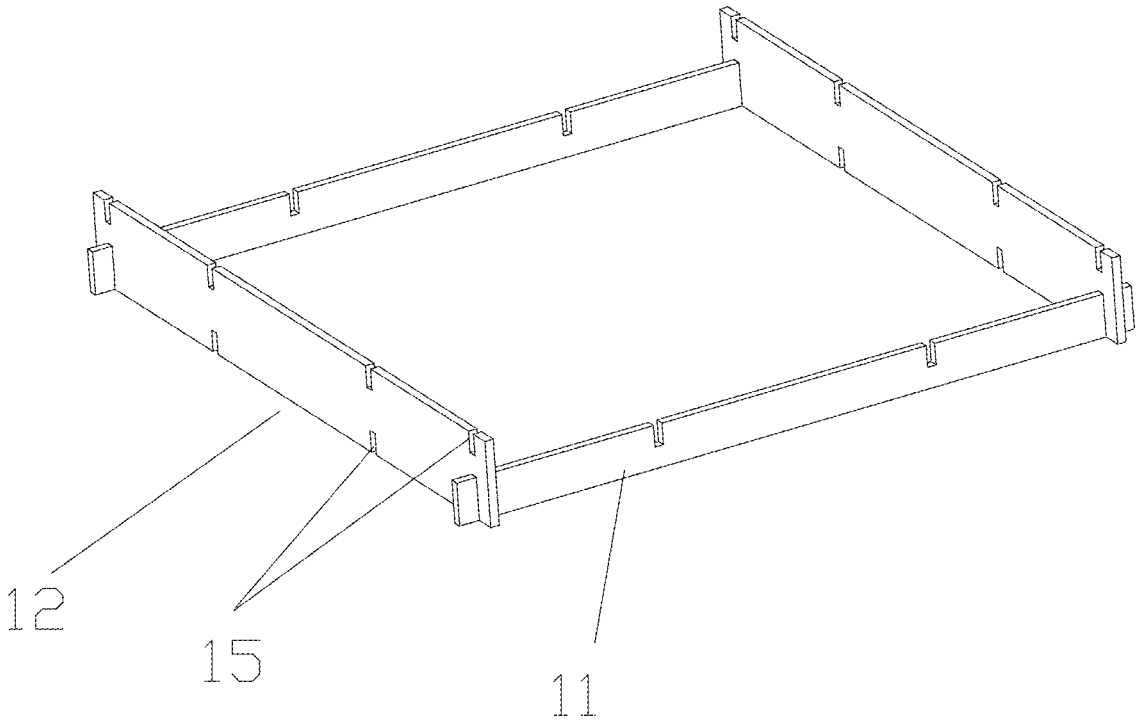
FIG. 8 is a schematic diagram of a partial assembly structure of an embodiment of the present disclosure.

In this embodiment, it can refer to FIG. 8. The wall panel unit 1 is a pair of symmetrically installed first long installation plates 11 as the base bottom, and then the second long installation plate 12 is clamped on one side between the first long installation plates 11, and the second long installation plate 12 is clamped on the other side between the first long installation plates 11, thereby forming the rectangular frame. Subsequent installation is also staggered upwards according to actual needs to form the required height.

In this embodiment, the required wall panel unit 1 can be assembled by combining and splicing the first long installation plates 11, the second long installation plates 12, the third short installation plates 13, and the H-shaped installation plates 14. At the same time, the wall panel unit 1 can be provided with functions such as a window, the movable door 3, and a window sill 7. The overall structure has simple and convenient assembly, firm installation, and can adjust the area and space according to actual needs, rendering it convenient for outdoor entertainment and play.

A top of the roof unit 2 is single-sided inclined, and the top of the roof unit 2 includes a set of unidirectional triangular installation plates 21 that are symmetrically arranged and a plurality of first cover plates 22. The first cover plates 22 are determined according to actual needs, and the present disclosure is not specifically limited. For example, there are ten first cover plates 22. Bottoms of the unidirectional triangular installation plates 21 are provided with at least two first connection grooves 26. Tops of the unidirectional triangular installation plates 21 are stepped structures, and an arc-shaped convex block 23 is provided at each step of the stepped structures. One sides of the unidirectional triangular installation plates 21 are provided with a connection notch 24, and the connection notch 24 also plays a role in assembling the connection plate, such as the first connection grooves 26 clamping upper and lower sides of the second long installation plate 12. Two sides of the first cover plate 22 are provided with a first bayonet 25 that is inserted into the arc-shaped convex block 23. The first cover plates 22 are provided between the unidirectional triangular installation plates 21, upper and lower of the first cover plates 22 adjacent to each other are inclined and stacked in sequence.

During actual installation, two unidirectional triangular installation plates 21 are respectively connected to a corresponding connection plate through the first connection groove 26, for example, connected to the second long installation plates 12, thereby forming a symmetrical installation. After installation, the first cover plates 22 are sequentially inserted onto the arc-shaped convex block 23, so that the first cover plates 22 are arranged from bottom to top, thereby forming the entire roof unit 2. The overall structure is simple and convenient to splice, and at the same time, the arc-shaped convex block 23 is provided at each step with a certain inclination, and the arc-shaped convex block 23 is also inclined in sequence. At the same time, they are partially stacked to prevent rainwater from entering the house, and can effectively drain and prevent water accumulation.

Figure 5:
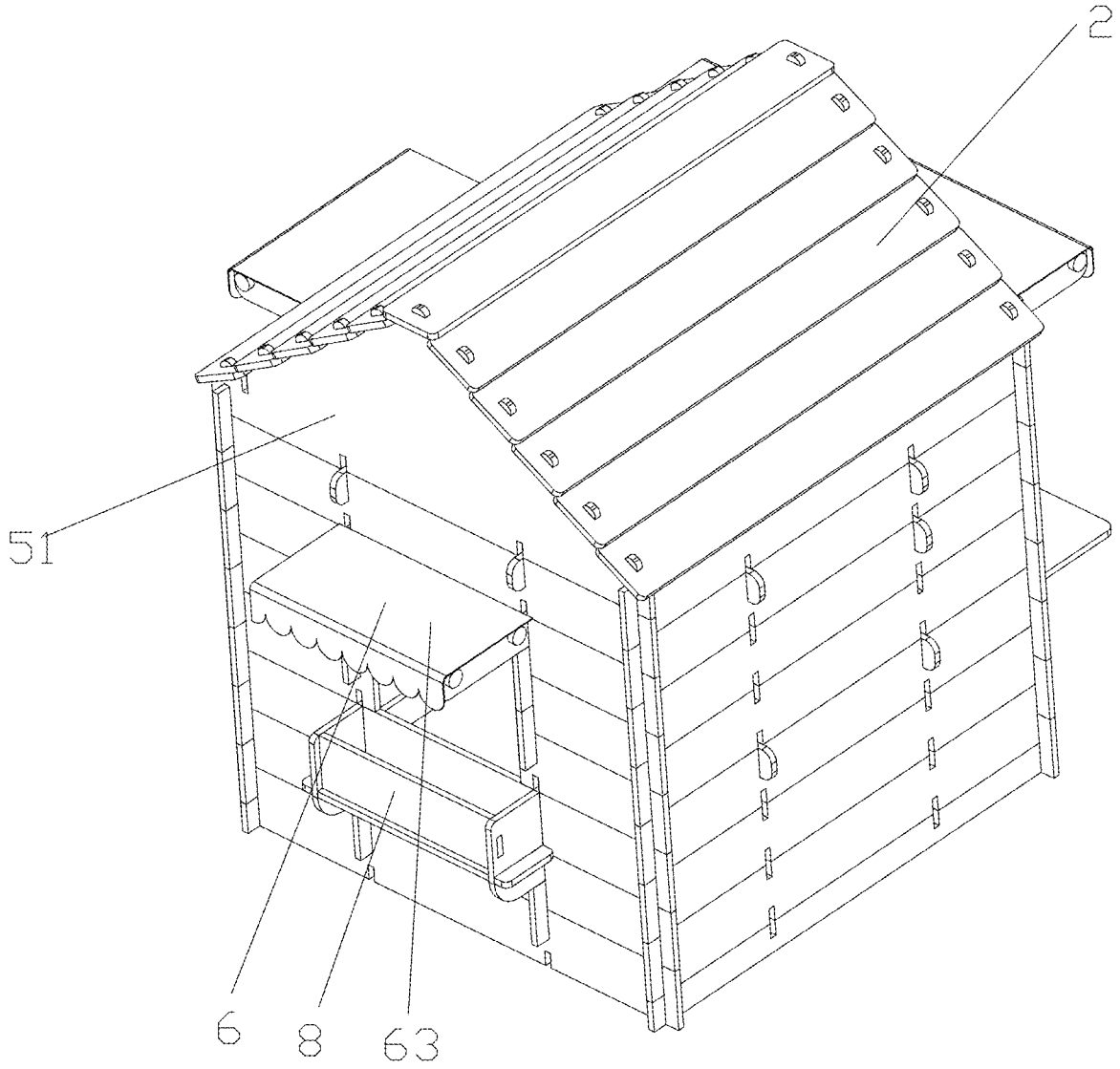
FIG. 5 is a schematic structural diagram of another embodiment of the present disclosure.
Figure 6:
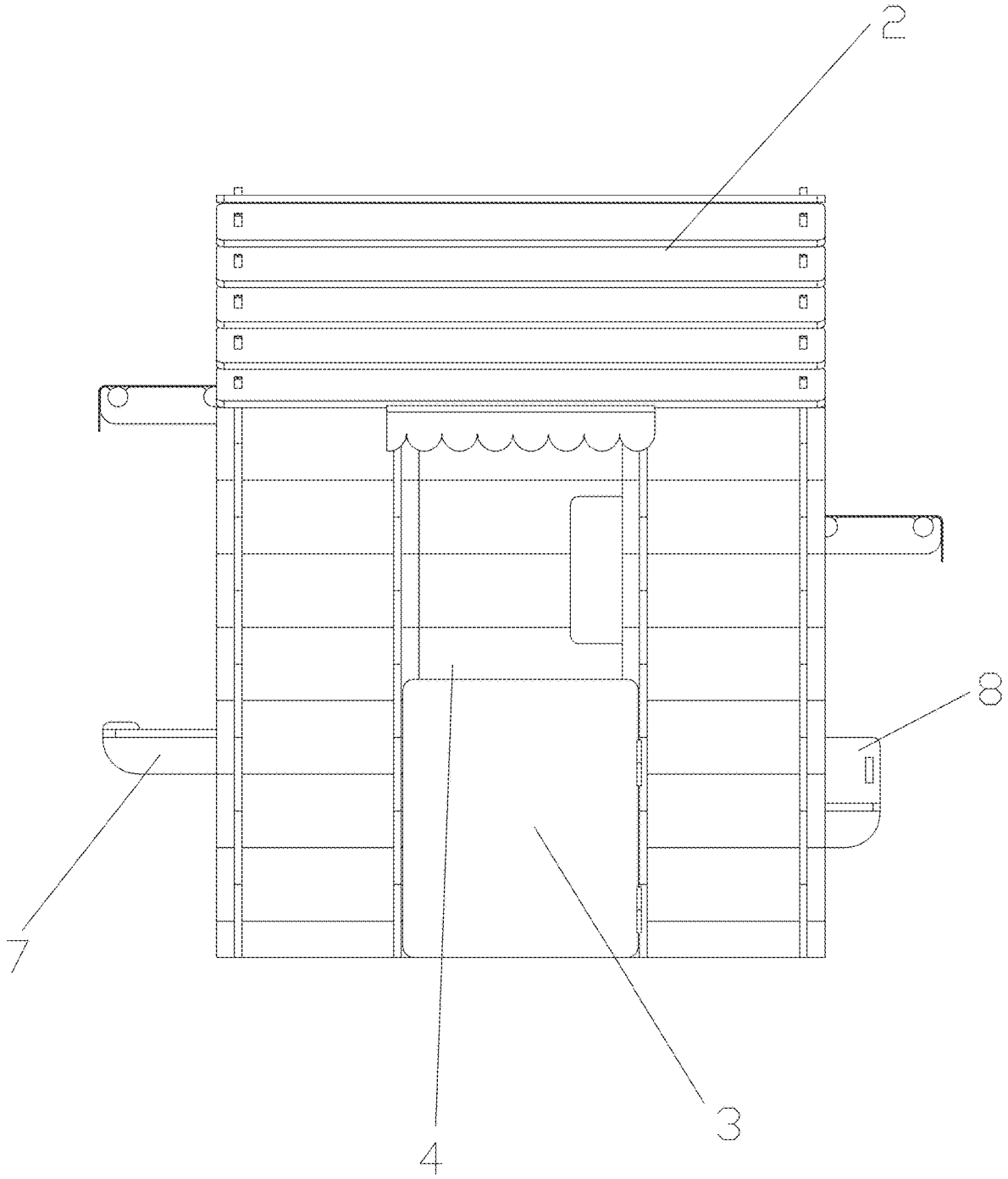
FIG. 6 is a schematic plan view of another embodiment of the present disclosure.
Figure 7:
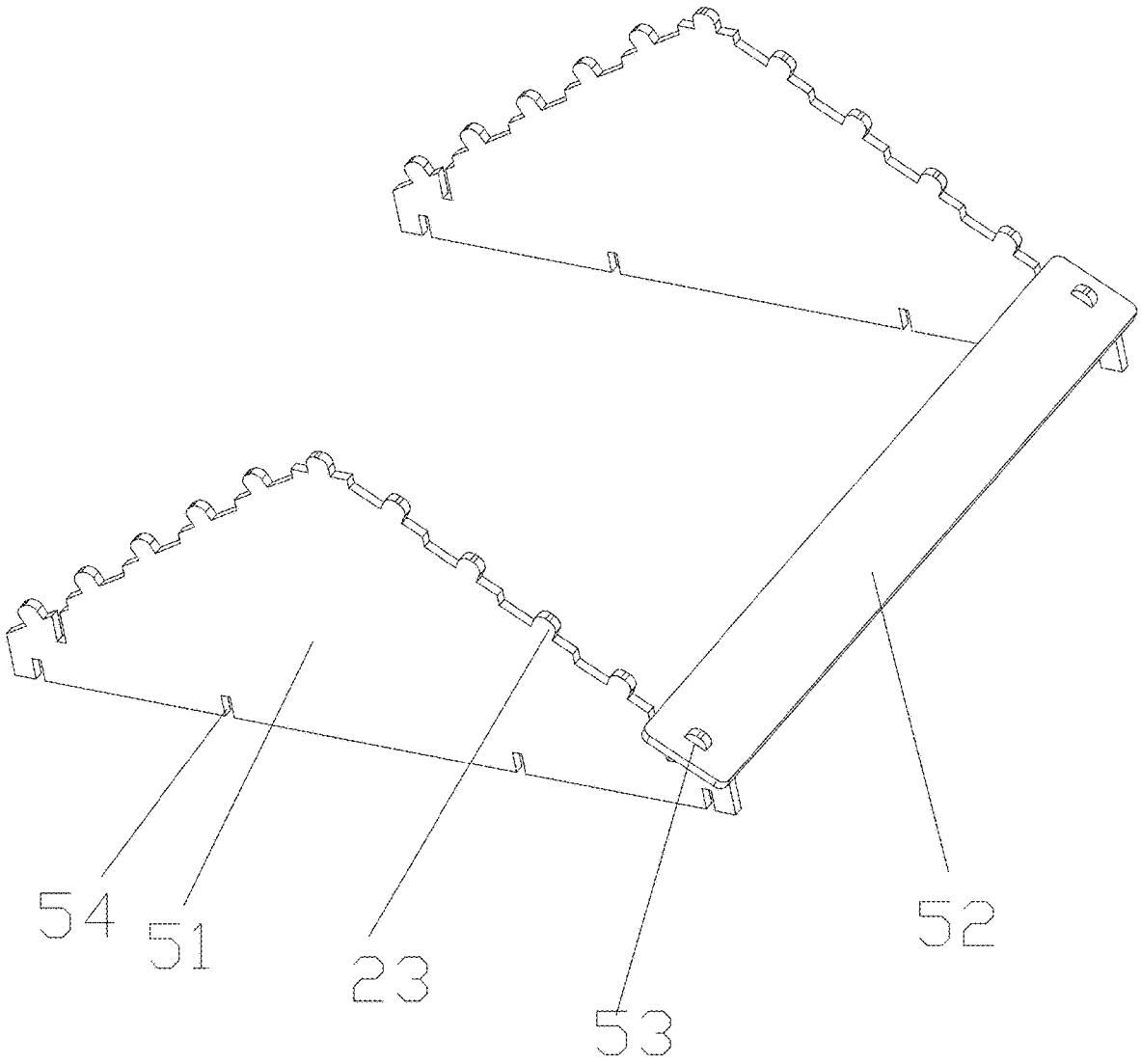
FIG. 7 is a schematic diagram of a connection of a bidirectional triangular installation plate of the present disclosure.

In an implementation mode, referring to FIGS. 5-7, the top of the roof unit 2 is inclined at two sides. The top of the roof unit 2 includes bidirectional triangular installation plates 51 and a plurality of second cover plates 52. The second cover plates 52 are determined according to actual needs and are not specifically limited in the present disclosure. In an implementation mode, there are eleven second cover plates 52, one is arranged at the top, and five are arranged on each side. Bottoms of the bidirectional triangular installation plates 51 are provided with at least three second connection grooves 54. Stepped structures are symmetrically arranged on two sides of the bidirectional triangular installation plates 51. Each step of the stepped structures of the bidirectional triangular installation plates 51 is provided with an arc-shaped convex block 23. The second cover plates 52 are provided with a second bayonet 53 on two sides that can be inserted into the arc-shaped convex block 23. The second cover plates 52 are provided between the bidirectional triangular installation plates 51. Middles of the bidirectional triangular installation plates 51 are inclined downwards along two sides, and upper and lower of adjacent second cover plates 52 are inclined and stacked in sequence.

In actual installation, the two bidirectional triangular installation plates 51 are respectively connected to a corresponding connection plate through the second connection grooves 54, in an implementation mode, connected to the second long installation plates to form a symmetrical installation. After installation, the second cover plates 52 are provided between the bidirectional triangular installation plates 51 to form the entire roof unit 2. The overall structure is simple and convenient to splice, and the inclined structure on two sides of the bidirectional triangular installation plates 51 facilitates rainwater falling. Each step is further provided with a certain inclined arc-shaped convex block 23, which can effectively drain water and prevent water accumulation.

In an implementation mode, referring to FIGS. 1-4, an interior of wall panel unit 1 is provided with one or more of a hook 10, a storage rack 9, and a curtain rod. The hook 10 is an S-shaped structure, one side of the hook 10 is clamped in an unassembled clamp slot 15, and the other side of the hook 10 can be configured for hanging items. The storage rack 9 includes a pair of clamping blocks 91 and a storage board 92. The pair of clamping blocks 91 are connected to one set of clamp slot 15, and the other part of the clamping blocks 91 is clamped between the storage boards 92; thereby enriching internal storage functions, convenient for entertainment, and all are connected through clamp connection for easy assembly.

Figure 4:
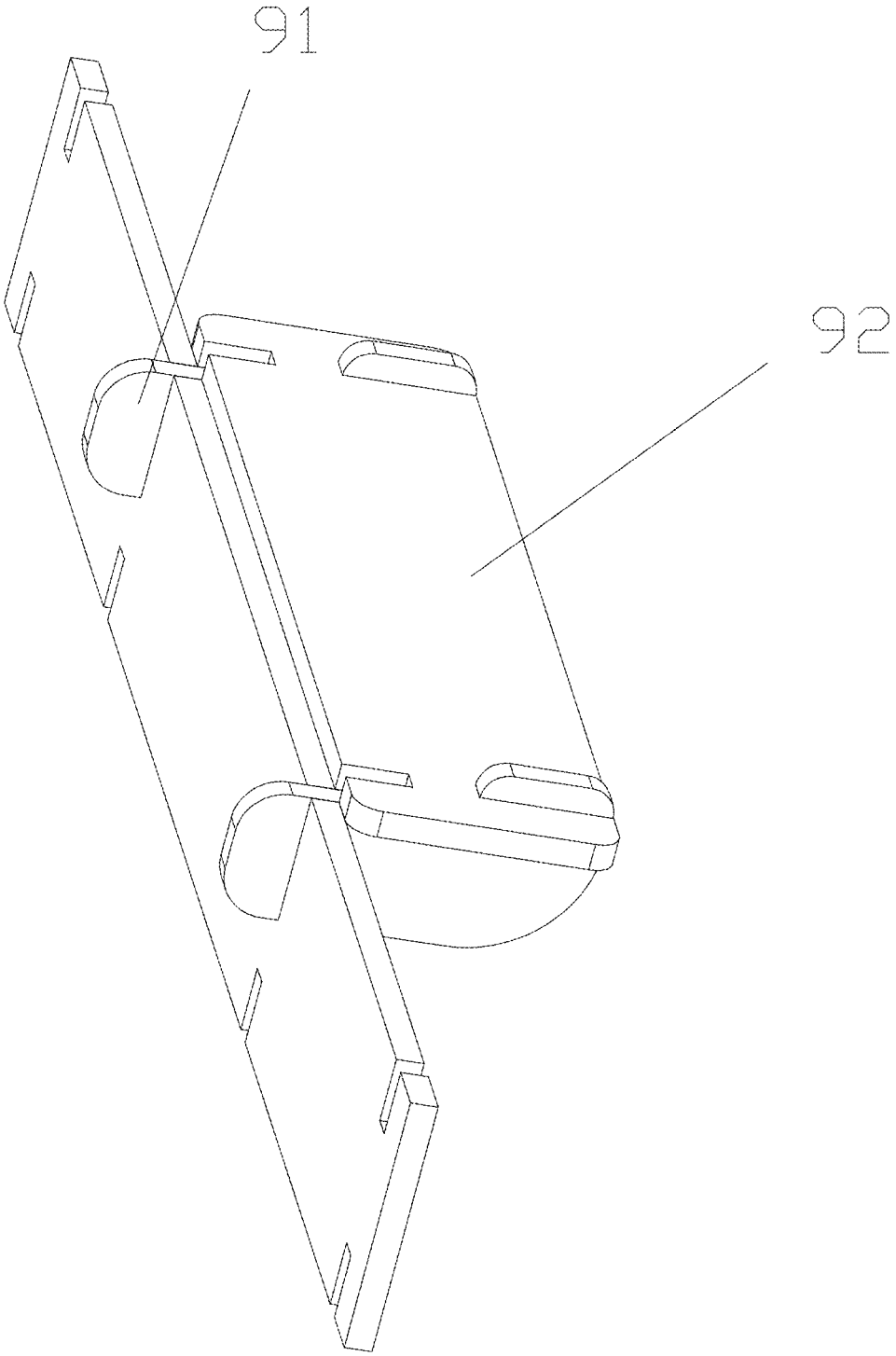
FIG. 4 is a schematic structural diagram of a storage rack of the present disclosure.

In an implementation mode, referring to FIGS. 4-6, two sides of the exterior of the wall panel unit 1 are provided with one installation port 4. One installation port 4 is configured to install the movable door 3, the movable door 3 is installed through a hinge joint. An upper of the other installation port 4 is provided with a protruding rain covering 6. A lower of the installation port 4 can be provided with a window sill 7 or a flower groove 8 according to actual needs. The flower groove 8 can be a rectangular frame structure or a rectangular frame formed by combining a plurality of plates. There are sockets 71 on two sides of the window sill 7, which are connected to the H-shaped installation plates 14 on two sides through the sockets 71. A pair of clamping plates 72 are provided on a lower of the window sill 7, and one side of the clamping plate 72 is connected to the clamp slot 15. The other side of the clamping plate 72 is configured to support the window sill 7, thereby enhancing the overall functionality of the house, allowing for the placement of items or flowers, as well as sun shading and other functions.

Figure 9:
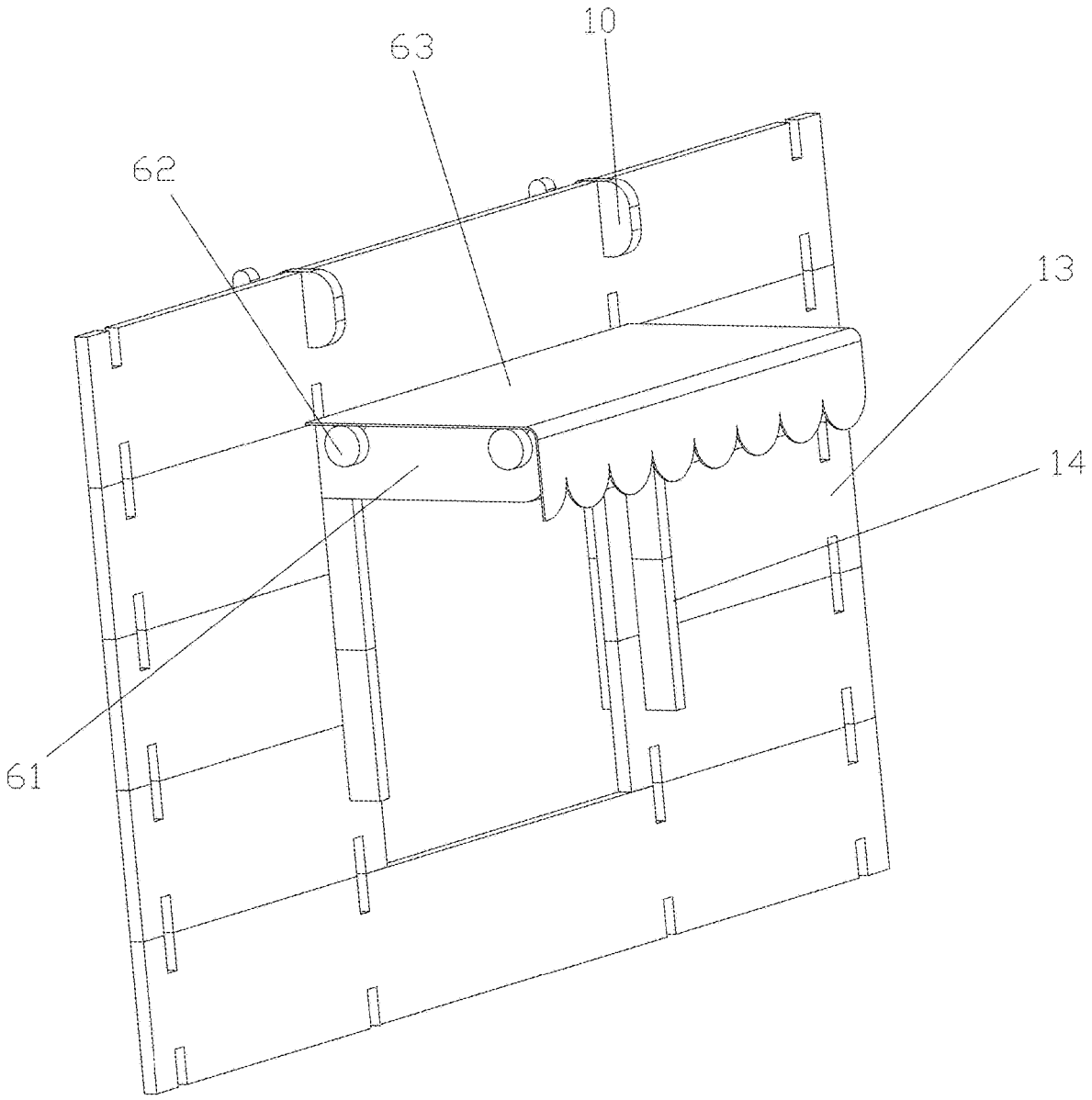
FIG. 9 is a schematic diagram of an installation of a protruding rain covering of the present disclosure.

In an implementation mode, referring to FIGS. 4-6, the wall panel unit 1 is provided with one installation port 4 on all three sides of the exterior. One of the installation ports 4 is configured to install a window, and an upper of the installation port 4 is provided with the protruding rain covering 6. Lowers of other installation ports 4 can be provided with the window sill 7 or flower groove 8 according to actual needs, and an upper can also be provided with the protruding rain covering 6 according to needs. Referring to FIG. 9, the windows are installed and fixed through the H-shaped installation plates 14. The protruding rain covering 6 consists of a pair of connection pieces 61, a pair of supporting crossbars 62, and a rain covering 63. One sides of the pair of connection pieces 61 are connected to a corresponding clamp slot 15, and uppers of the connection pieces 61 are provided with a circular slot for connecting the supporting crossbars 62. The connection pieces 61 and the supporting crossbars 62 are provided with the rain covering 63, and a bottom of the rain covering 63 is provided with a clamping block that is connected to the supporting crossbars 62, which can achieve rain protection at an outer side.

What is claimed is:

1. An assemble house, comprising a wall panel unit, a roof unit, and a movable door, wherein the wall panel unit is a rectangular structure, and an upper of the wall panel unit is capable of being detachably connected to the roof unit;

one or more sides of the wall panel unit are provided with at least one installation port, and the installation port is hinged with the movable door;

the wall panel unit comprises a plurality of first long installation plates, second long installation plates, third short installation plates, and H-shaped installation plates;

upper sides of the first long installation plates are provided with at least two clamp slots, upper and lower sides of the second long installation plates and the third short installation plates are symmetrically provided with the at least two clamp slots, the at least two clamp slots include four clamp slots, the four clamp slots include two unconnected clamp slots, and the H-shaped installation plates are formed at two sides of the installation port;

wherein the wall panel unit is provided with a storage rack, the storage rack comprises a pair of clamping blocks and a storage board, the clamping blocks are connected to the two unconnected clamp slots, and the clamping blocks are clamped to the storage board;

wherein a top of the roof unit is inclined at one side;

wherein the top of the roof unit comprises a set of unidirectional triangular installation plates that are symmetrically arranged and a plurality of first cover plates, bottoms of the unidirectional triangular installation plates are provided with at least two first connection grooves, tops of the unidirectional triangular installation plates are stepped structures, and an arc-shaped convex block is provided at each step of the stepped structures;

sides of the unidirectional triangular installation plates are provided with a connection notch, and two sides of the first cover plates are provided with a first bayonet that is inserted into the arc-shaped convex block;

the first cover plates are provided between the unidirectional triangular installation plates, and upper and lower of adjacent first cover plates are sequentially inclined and stacked.

2. The assemble house according to claim 1, wherein lengths of the first long installation plates are the same as lengths of the second long installation plates, heights of the first long installation plates are half of heights of the second long installation plates;

heights of the second long installation plates, the third short installation plates, and the H-shaped installation plates are all the same.

3. The assemble house according to claim 2, wherein the first long installation plates are symmetrically arranged, a left side of each of the first long installation plates is clamped to the second long installation plates, and a right side of each of the first long installation plates is clamped to the second long installation plates or the third short installation plates;

the left or right side of each of the first long installation plates and a left or right side of each of the second long installation plates are respectively cross clamped with the second long installation plates, the third short installation plates, or the H-shaped installation plates.

4. The assemble house according to claim 1, wherein the at least two clamp slots include five clamp slots including three unconnected clamp slots, wherein the wall panel unit is provided with a hook inside, and the hook is a S-shaped structure, one side of the hook is clamped in at least one of the unconnected clamp slots.

5. The assemble house according to claim 1, wherein two sides of an exterior of the wall panel unit are provided with installation ports, one of the installation ports is provided with the movable door, an upper of the other installation port is provided with a protruding rain covering, a lower of the installation port is provided with a window sill or a flower groove, wherein if the window still is present, two sides of the window sill are provided with sockets;

a pair of clamping plates are provided on a lower portion of the window sill.

6. The assemble house according to claim 5, wherein the protruding rain covering is composed of a pair of connection pieces, a pair of supporting crossbars, and a rain covering;

one sides of the connection pieces are respectively connected to one corresponding clamp slot of the at least two clamp slots, and upper sides of the connection pieces are provided with a circular slot configured to connect the supporting crossbars;

the rain covering is provided on the connection pieces and the supporting crossbars.

7. The assemble house according to claim 1, wherein three sides of an exterior of the wall panel unit are all provided with one installation port, and one of the installation ports is configured to install a window.

* * * * *